US006729535B2

(12) United States Patent
Lackey et al.

(10) Patent No.: US 6,729,535 B2
(45) Date of Patent: May 4, 2004

(54) MAILBOX HAVING STACKABLE COMPONENT PARTS

(75) Inventors: Robert W. Lackey, Hickory, NC (US); Roy V. Nicholson, Boone, NC (US)

(73) Assignee: RWL Corporation, Hickory, NC (US)

( * ) Notice: Subject to any disclaimer, the term of this patent is extended or adjusted under 35 U.S.C. 154(b) by 0 days.

(21) Appl. No.: 10/165,552

(22) Filed: Jun. 7, 2002

(65) Prior Publication Data

US 2002/0190116 A1 Dec. 19, 2002

Related U.S. Application Data

(63) Continuation-in-part of application No. 09/528,692, filed on Mar. 20, 2000, now abandoned.

(51) Int. Cl.[7] ..... B65D 91/00
(52) U.S. Cl. ..... 232/17; 232/38
(58) Field of Search ..... 232/17, 38, 45, 232/29, 33; 206/505, 507, 508, 515, 518; 220/4.28, 4.26, 4.27

(56) References Cited

U.S. PATENT DOCUMENTS

| | | | | |
|---|---|---|---|---|
| 1,204,494 A | | 11/1916 | Sare | |
| 2,412,325 A | | 12/1946 | Devine et al. | |
| 4,244,512 A | | 1/1981 | Wise | |
| 4,275,829 A | | 6/1981 | Johnson et al. | |
| 4,813,595 A | | 3/1989 | Johns, Jr. et al. | |
| 5,035,356 A | * | 7/1991 | Granger | 232/17 |
| 5,201,465 A | | 4/1993 | Limehouse | |
| 5,207,378 A | | 5/1993 | Detchon | |
| 5,337,953 A | | 8/1994 | Haest | |
| 5,337,954 A | | 8/1994 | Kobilarcik et al. | |
| 5,361,977 A | | 11/1994 | Ogrodnick, Jr. | |
| 5,425,501 A | | 6/1995 | Wesorick | |
| 5,575,422 A | | 11/1996 | Peterman | |
| 5,664,729 A | | 9/1997 | Ladewig | |
| 5,692,617 A | | 12/1997 | Adams | |
| 5,988,495 A | | 11/1999 | Lackey et al. | |

* cited by examiner

*Primary Examiner*—William L. Miller
(74) *Attorney, Agent, or Firm*—J. Herbert O'Toole; Nexsen Pruet, LLC

(57) ABSTRACT

A mailbox having stackable component parts for efficient transport and storage of the parts. The mailbox is sold as a kit of component parts for quick and easy assembly onto a standard 4×4 inch or 6×12 inch post. The mailbox may be fit with a decorative cover and detachable ornamental flag.

6 Claims, 8 Drawing Sheets

MAILBOX HAVING STACKABLE COMPONENT PARTS

CROSS REFERENCE TO OTHER APPLICATIONS

This application is a continuation-in-part of U.S. patent application Ser. No. 09/528,692 filed Mar. 20, 2000, now abandoned.

BACKGROUND OF THE INVENTION

1. Field of the Invention

The present invention relates to a mailbox and more particularly, the device of the present invention relates to a mailbox comprising stackable component parts for space conservation during transport and storage.

2. Description of Related Art Including Information Disclosed Under 37 CFR 1.97 and 37 CFR 1.98

Mailboxes are commonly sold in a variety of outlets ranging from craft shops to department stores and home centers. When mailboxes are shipped to a retailer, they are usually boxed individually or for display on the retailer shelf. While mailboxes come in many sizes and shapes, they are often at least twenty inches long, eight inches high and seven inches wide. With their bulky size, mailboxes rapidly take up cargo space during shipping and then use up valuable warehouse space and display space on retailers' shelves.

U.S. Pat. No. 5,988,495 discloses a nestable mailbox. It provides for a method of transporting pre-assembled mailboxes, in a nested configuration to improve the efficiency of shipping.

U.S. Pat. No. 5,664,729 discloses a molded plastic mailbox comprising a series of component parts which are snap fitted and screwed together. This reference does not disclose the adaptation or ability of these parts for compact space-saving packaging for either storage or transport.

U.S. Pat. No. 5,575,422 discloses an extruded reinforced and vandal proof mailbox. Attachment means and several reinforcement ribbons preclude the space-saving stacking of mailbox components.

U.S. Pat. No. 5,361,977 discloses a modular mailbox housing assembly including at least one hollow unitary base module for being positioned on a supporting surface.

U.S. Pat. No. 5,337,954 discloses a mailbox mounting bracket. The mailbox disclosed for use therewith is not suitable for efficient packing.

U.S. Pat. No. 5,337,953 discloses a plastic mailbox for receiving mail which has a removable inner container, thus permitting the container to be removed from the exterior casing to empty the mail at another location.

U.S. Pat. No. 5,207,378 discloses a mailbox decorative attachment. Such attachment adheres to the curved outer surface of the mailbox and a portion of the pictorial representation projects outside and maybe under, above, or around the mailbox.

U.S. Pat. No. 5,201,465 discloses a mailbox signaling device which indicates that a door to a mailbox has been opened for the placement of mail within the mailbox.

BRIEF SUMMARY OF THE INVENTION

It is an object of the present invention, therefore, to provide a mailbox and a method of transporting and storing a plurality of mailboxes which maximizes the efficient use of cargo and storage space.

It is a further object of the present invention to provide a mailbox and a method of transporting and storing a plurality of mailboxes which allows quick and easy assembly.

It is a further object of the present invention to provide a mailbox and a method of transporting and storing a plurality of mailboxes which allows for the attachment of ornamental coverings or ornamental housings as seasonal replacements on a mailbox housing.

It is still a further object to allow for the replacement of each of the components of the mailbox at minimal expense and essentially without tools.

These and other objects may be attained in one aspect of the present invention in a mailbox assembly comprising a U-shaped housing having at least one detent; a base portion having means for securing a U-shaped housing to form a mailbox; at least one pivotally mounted door adapted to be fastened onto the base portion; and a backing attached to the base portion and to said U-shaped housing; wherein each of the U-shaped housing base portion, door and backing are each adapted to be stacked for efficient use of storage space during general storage and transport.

These and other objects may be attained in a second aspect of the present invention in a mailbox assembly comprising a mailbox housing; a base portion for receiving the mailbox housing; a door adapted to be fastened onto the base portion; and a backing attached to the mailbox housing; wherein the mailbox housing is adapted for attachment to the base portion, the mailbox housing being adapted to fit, concentric to and substantially flush within, a second mailbox housing to enable stacking for maximum use of storage and cargo space.

In a third aspect of the invention, all of the components above the base are attached using snap fit attachments which use spring-like characteristics of each component to hold each component in place.

DETAILED DESCRIPTION

Figure 1A:
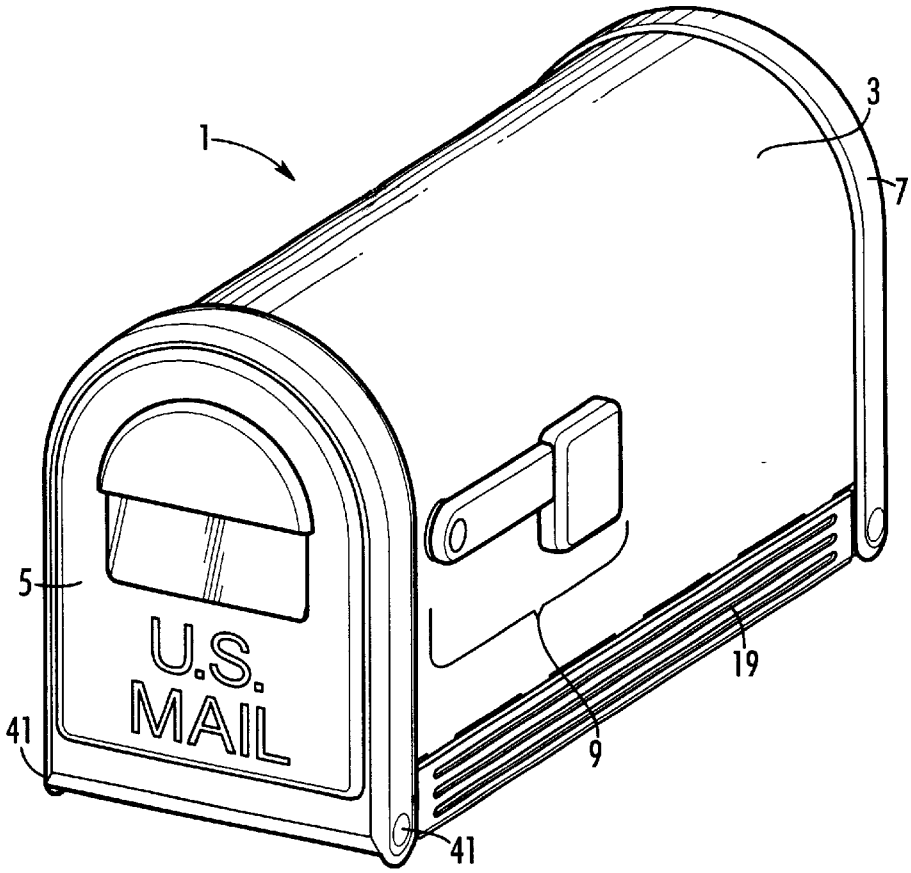
FIG. 1A is a perspective view of a mailbox in accordance with the present invention.

The present invention provides a mailbox comprising stackable component parts for space-efficient storage and transport. In today's marketplace, the cost of shipping often constitutes a substantial portion of manufacturing, storage and delivery costs. In many cases, manufacturing sites and consumers are separated by oceans, requiring long distance transport. Therefore, in order to save costs during long and short distance shipping, there exists a need for conservation of cargo space, particularly for goods having high bulk-to-weight ratios.

Recent economic globalization has similarly ushered in just-in-time inventory schemes to save the cost of simple storage both at manufacturing sites, as well as wholesale and retail sites. Even with this advance, however, problems involving inventory shortage persist. Limited storage space allows only a finite amount of inventory. As such, there exists a need for conservation of storage space, particularly in the case of normally hollow bodied containers such as mailboxes.

Another aspect of the global economy is that components for almost any product may be sourced in several nations and matched for assembled in a third. To the extent that shipping charges can be minimized and assembly minimized or eliminated, cost savings are achieved.

The device of the present invention therefore, achieves this economy of space by providing stackable component parts resulting in a more dense package. Moreover, the device of the present invention provides a mailbox adapted for quick and easy assembly and installation. In addition, the components may be selected on a mix-and-match basis and individual components may be selected and replaced separately.

In a preferred embodiment, the housing comprises a smooth and stackable piece. Stacking of these housings, therefore, nearly eliminates unused space between the housings, because multiple housings are substantially flush when placed one upon another. Housings may be stacked indefinitely to form stacks having an indefinite number of housing units. Thus, the housing of the present invention is adapted to fit concentric to and substantially flush within a second, identical housing to enable stacking for maximum use of storage and cargo space.

Likewise, the base portion is adapted to fit flat upon a second, identical base portion to enable stacking for maximum use of storage and cargo space. Stacking of base portions, therefore, nearly eliminates unused space between the base portions, because multiple base portions are substantially flush when placed one upon another. Base portions may be stacked indefinitely to form stacks having an indefinite number of base portion units. Thus, the housing and base portion of the present invention are each adapted to be stacked for efficient use of storage space during general storage and transport. Likewise, the ends have a common size and shape and may be doors or a blank of the same shape.

Moreover, this embodiment of the present invention provides a mailbox adapted for quick and easy assembly. Component parts are not only stackable, they are easy to assemble. The mailbox is designed for sale as a kit of component parts. Thus, this embodiment of the device of the present invention comprises a base portion to which the housing door(s) and/or end plate are attached. The base may be attached to conventional mailbox posts (which are usually capped with a 6"×12"×1" plate) and the housing door and end then applied. The base may be mounted by screwing or nailing down through the base, avoiding trying to screw or nail into the side of a 1" board.

Figure 1B:
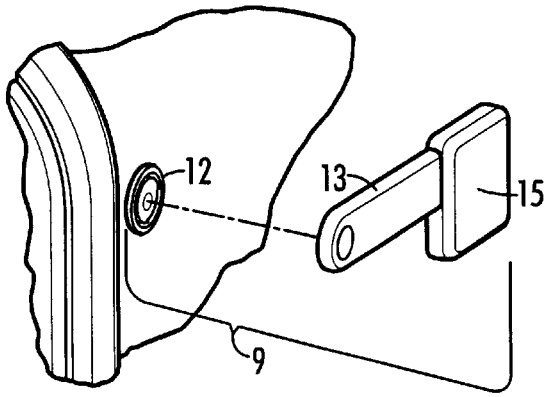
FIG. 1B is a cut-away perspective view of a snap-on flag assembly of the mailbox in FIG. 1*a*, in accordance with one embodiment the present invention.

In a preferred embodiment and as seen in FIG. 1A, the assembled mailbox 1 comprises a U-shaped housing 3 and a base portion 19. A pivotally mounted door 5 is fastened onto base portion 19, preferably by either plastic rivets 41 or by knobs or truncated hinge pins formed into the door plate. Backing 7 which may be another door 15 is fastened to base portion 19 in the same fashion and snugly fits around U-shaped housing 3. Door 5 closes around the opposite end of U-shaped housing 3 in similar fashion. As seen in FIG. 1B, flag assembly 9 comprises transition piece 12 and detachable flag arm piece 13 having a flag 15. When a door is used at both ends, the mailbox is a pass-through and the user need not stand in the road while retrieving the mail.

Figure 2:
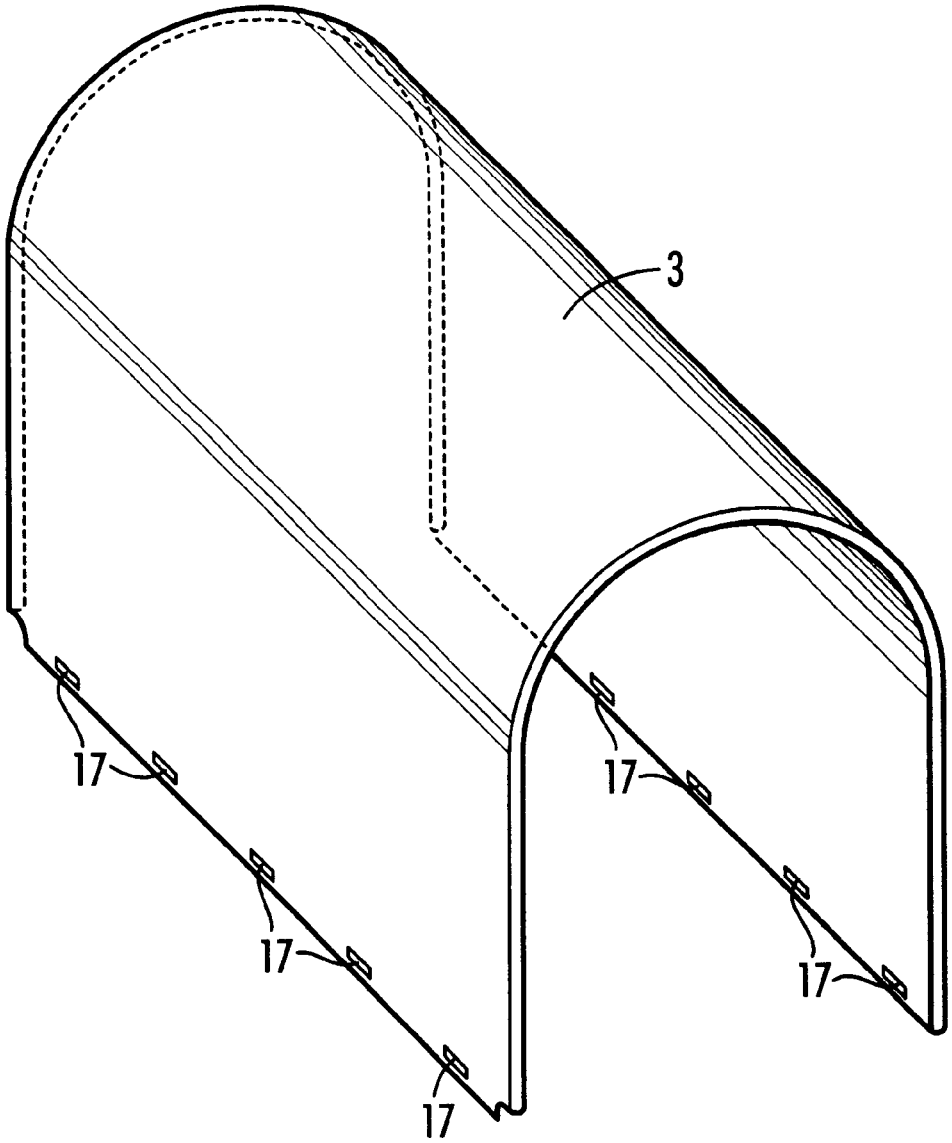
FIG. 2 is a perspective view of a housing of the mailbox in FIG. 1, in accordance with the present invention.
Figure 3:
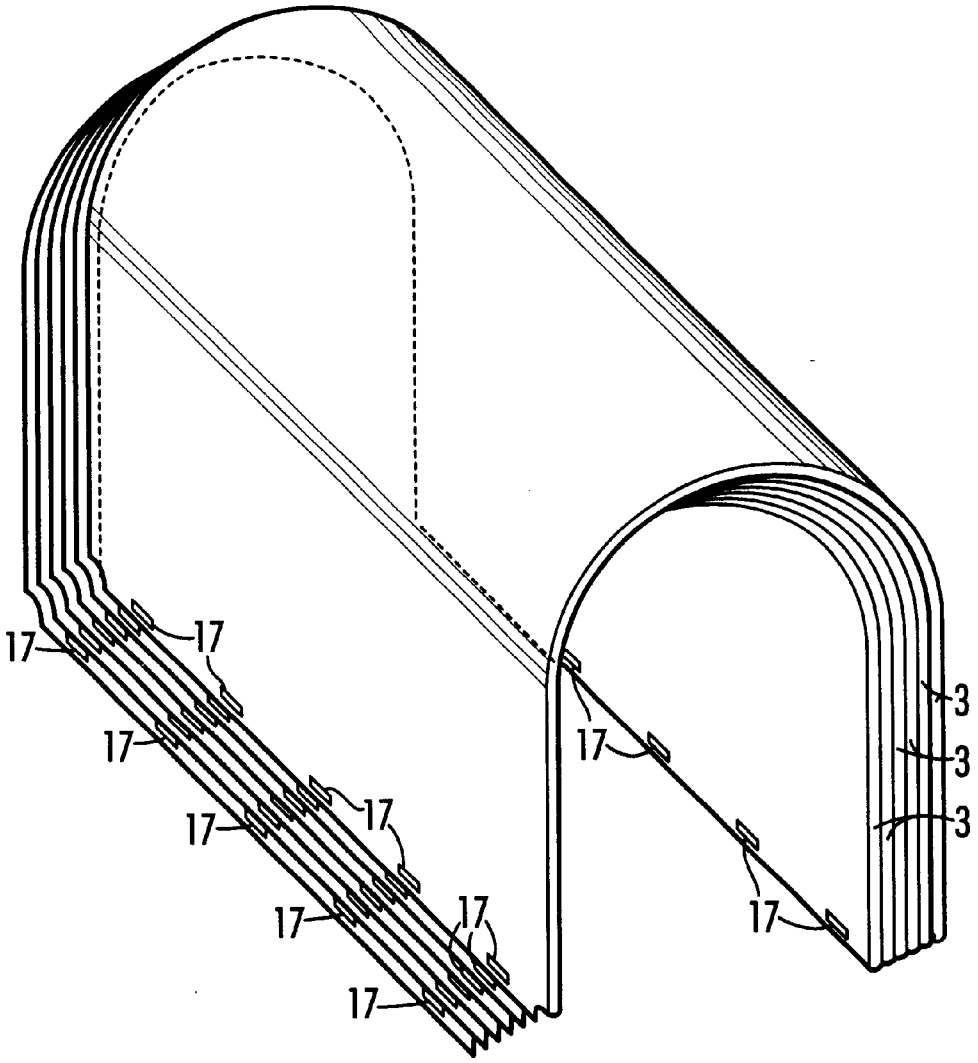
FIG. 3 illustrates a plurality of stacked housings such as the one in FIG. 2, in accordance with the present invention.
Figure 6:
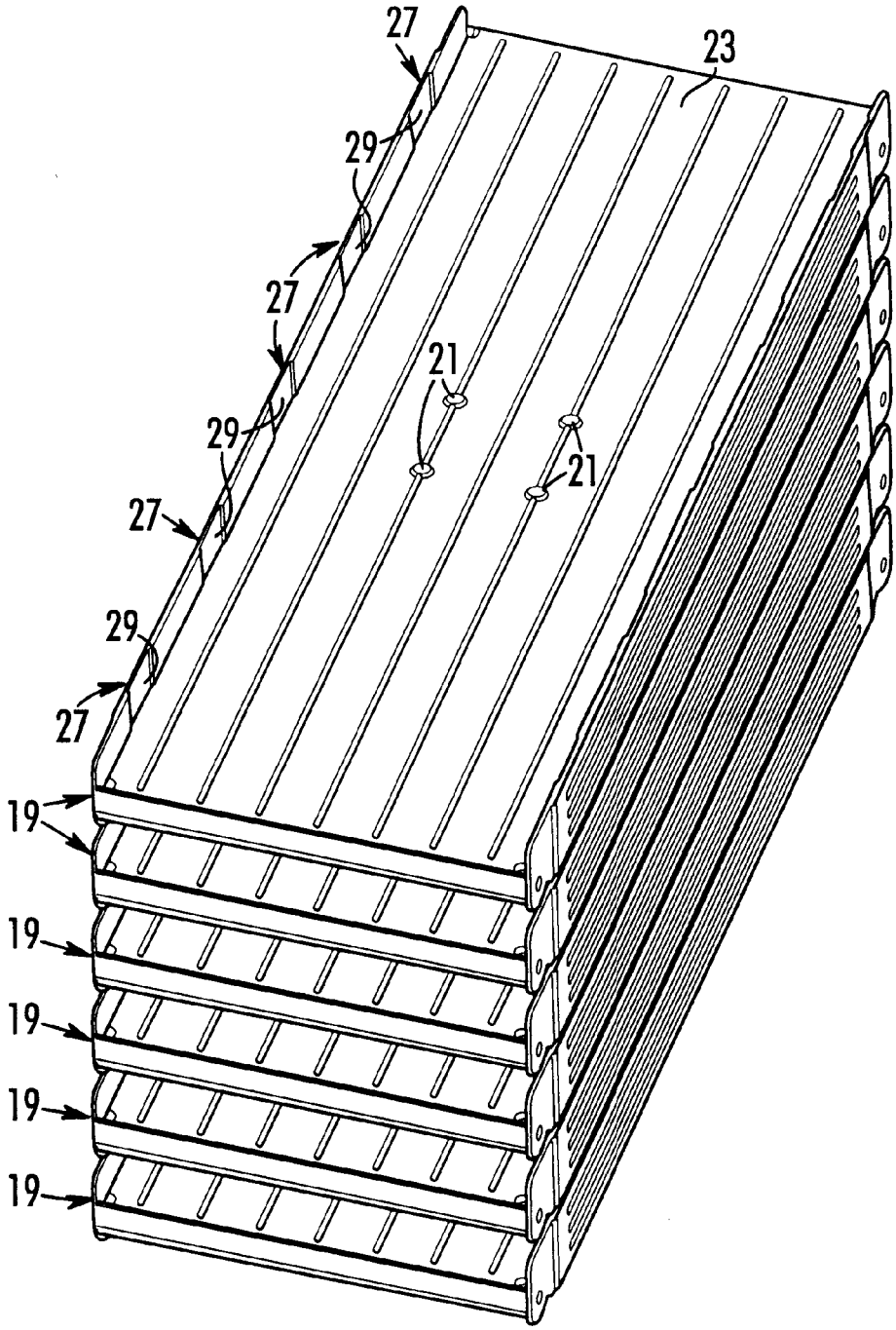
FIG. 6 illustrates a plurality of stacked base portions such as the one in FIG. 5, in accordance with the present invention.

FIG. 2 shows a housing 3. Once stacked one upon another as shown in FIG. 3, housing 3 conserves space through a concentric and substantially flush fit. Detents 17 are part of one attachment system as will be detailed vide infra. Base portion 19 is similarly stackable as shown in FIG. 6.

Figure 4:
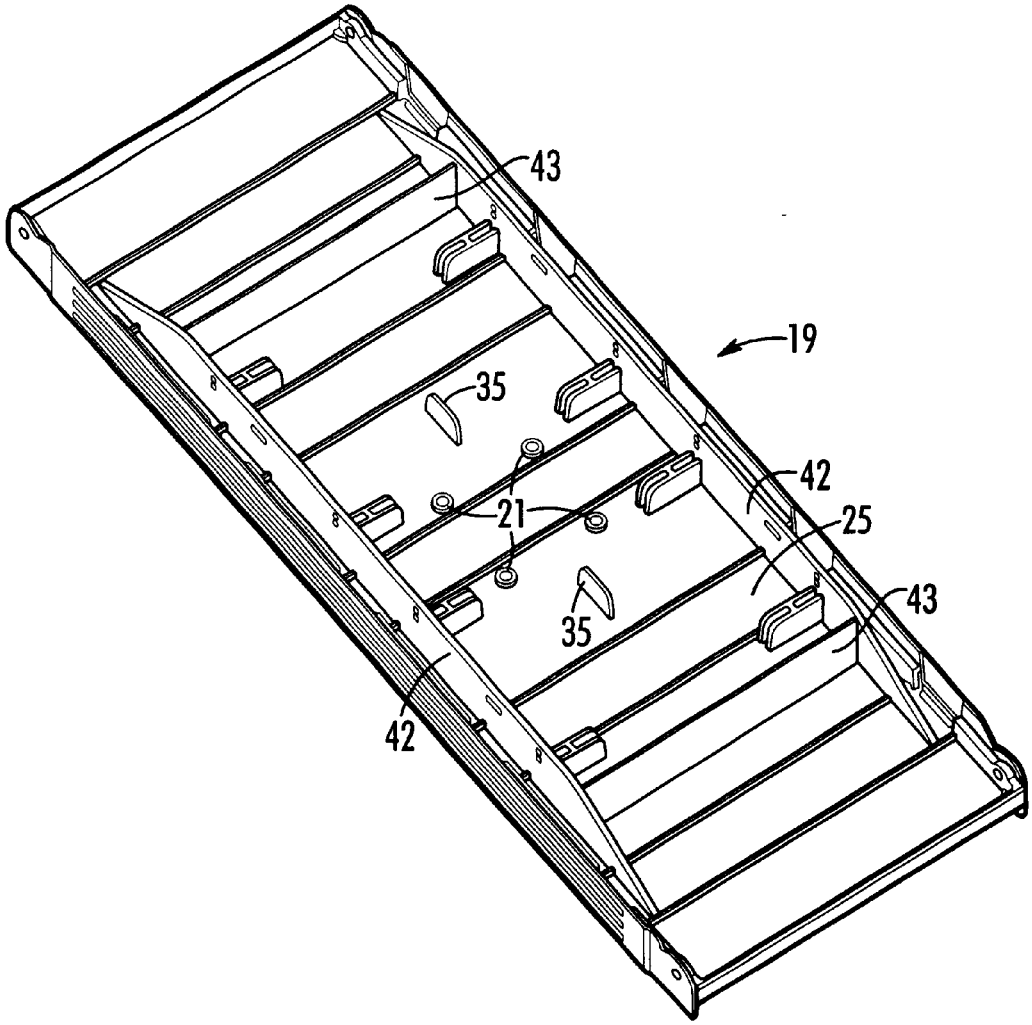
FIG. 4 illustrates the bottom side of a base portion of the mailbox in FIG. 1, in accordance with the present invention.
Figure 5:
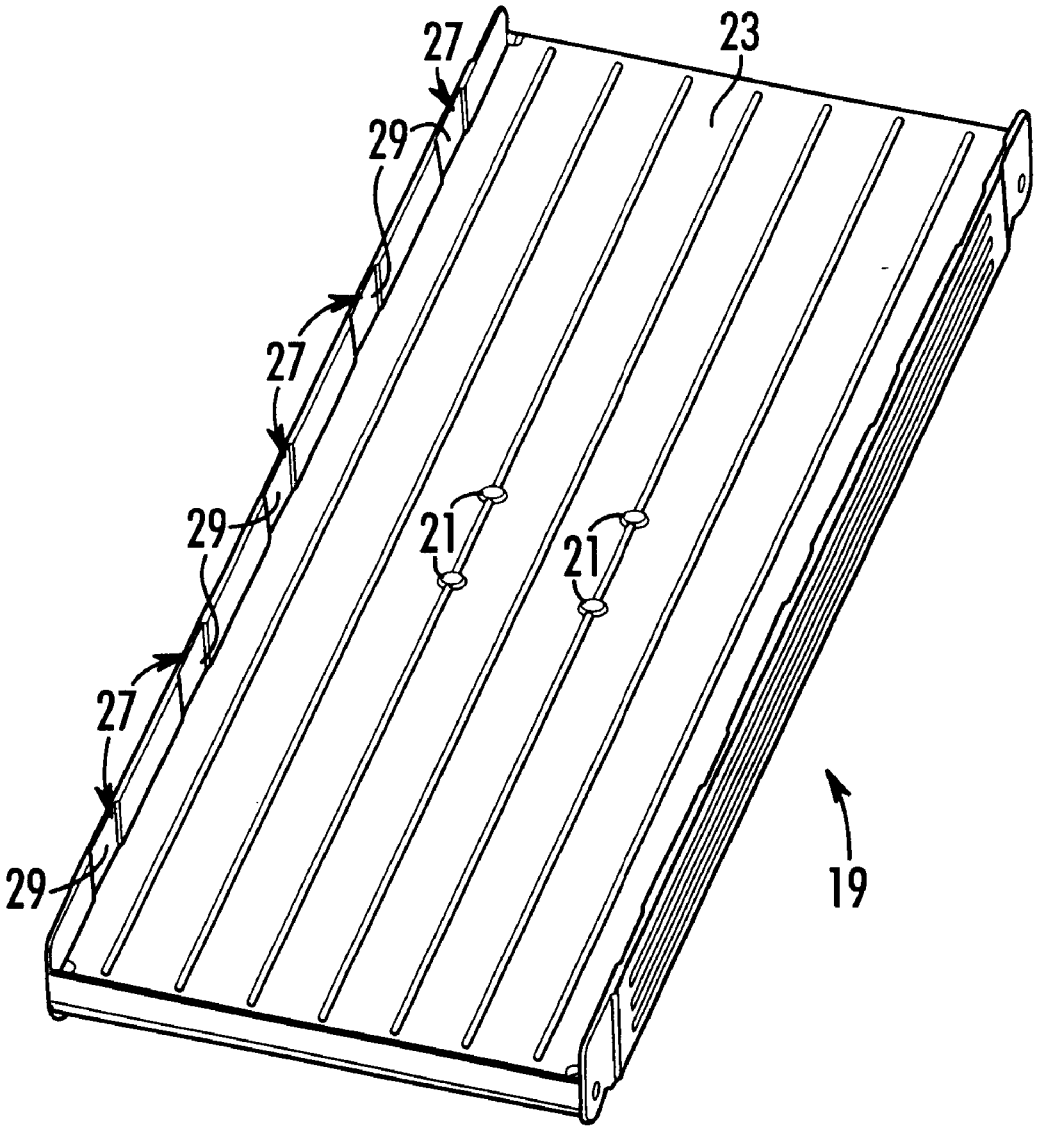
FIG. 5 illustrates the top side of a base portion of the mailbox in FIG. 1, in accordance with the present invention.

FIGS. 4 and 5 illustrate a post fitting adaptation and securing mechanism of base portion 19. Top side 23 (as seen in FIG. 5) has holes 21 formed through base portion 19 to bottom side 25 (as seen in FIG. 4). Tabs 35 may be used to help position bottom side 25 onto a top of a 4×4 inch post.

Alternatively, the base may be mounted to a conventional 6"×12"×1" board as is used with conventional mailboxes. The side walls 42 and end walls 43 lock the base onto the edge of the standard mounting board.

Once base portion 19 is placed onto a post, a securing device such as a nail, screw, or other fastener fits into holes 21 through top side 23 shown in FIG. 5 to secure base portion 19 onto the post or mounting board.

Preferably, base portion 19 is a hard engineering plastic, preferably durable enough to resist cracking and chipping. Polypropylene, impact modified polystyrene, filled polyurethane, PET, Nylon 66 and polycarbonate are suitable. Door 5 and backing 7 preferably are more ductile, impact resistant plastics including unmodified polystyrene, polypropylene and polyurethane. Sufficient flexibility is present to provide a water-resistant seal with the U-shaped housing. Preferably, U-shaped housing is made of sheet metal, and flag assembly 9, including transition piece 11 and detachable flag arm piece 13, is plastic.

Once base portion 19 is secured to a post, U-shaped housing 3 snaps into base portion 19. In one embodiment specially adapted detents 17 and locking tabs 29. As seen in FIG. 2, U-shaped housing 3 has a number of detents 17. As seen in FIG. 5, base portion 19 has retractable male locking tabs 29 which are preferably angularly disposed plastic detent tabs, at locations 27 and which are adapted to fit into detents 17 of the U-shaped housing 3. Accordingly, housing 3 snaps into place on base portion 19. Then, mailbox assembly 1 is completed upon attachment of door 5, backing 7 and removable, snap-on flag assembly 9. Transition piece 11 of flag assembly 9 is shown in FIGS. 1*a* and 1*b* and is preferably fastened onto housing 3 by a metal screw. Various ornamental flag arm pieces 13 are then attached and detached according to season preference or as otherwise required. In addition, an ornamental cover may be fit into slots 27 of base portion 19.

Figure 5A:
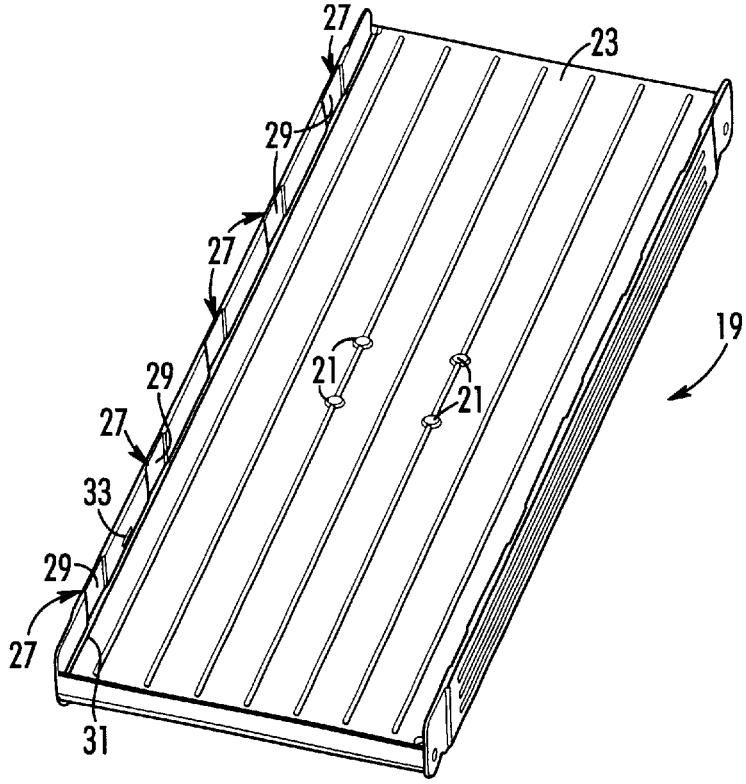
FIG. 5A illustrates a second embodiment of a top side of a base portion of the mailbox of FIG. 1.
Figure 5B:
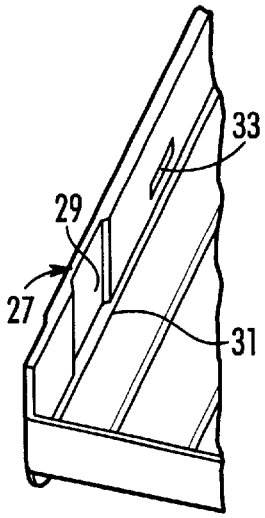
FIG. 5B is an illustration of a portion of the mounting system for the base according to the embodiment of FIG. 5A.

As shown in FIGS. 5A and 5B, the U-shaped housing may also be attached to the base using slot 31 into which the edge of the housing is engaged and with tab 29 which presses the housing inwardly and snaps into detent 17. The U-shaped housing is formed to a shape which is less than 180°, creating a spring tension when the edges are inserted into the slots 31. Metal, especially sheet steel, is much preferred over plastics for the housing because the spring constant is greater and does not diminish significantly over time in the hot sun.

Figure 7A:
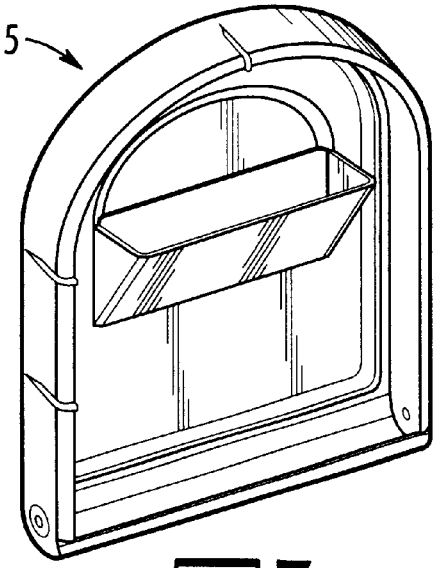
FIG. 7A illustrates the inside of a door of the mailbox in FIG. 1, in accordance with the present invention.
Figure 7B:
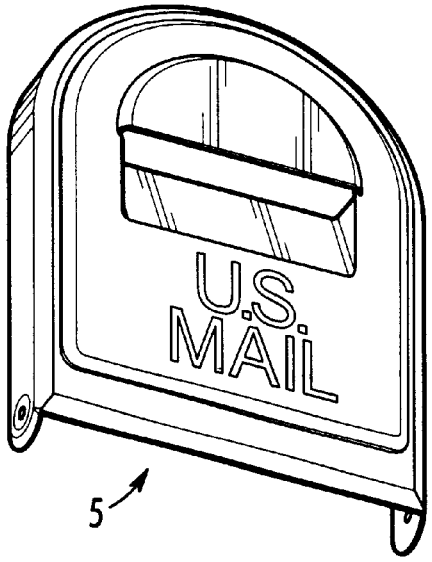
FIG. 7B illustrates the outside of a door of the mailbox in FIG. 1, in accordance with the present invention.

FIG. 6 shows a stacking of bases 19 showing the compactness of the stack in shipping and storage FIGS. 7A and 7B show the front and back of a door adapted for separate hinge pins.

Figure 8A:
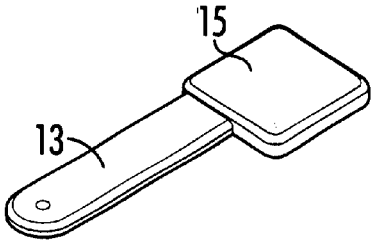
FIG. 8A illustrates the outside of a detachable flag arm piece of the mailbox in FIG. 1, in accordance with the present invention.
Figure 8B:
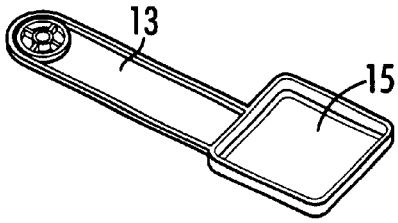
FIG. 8B illustrates the inside of a detachable flag arm piece of the mailbox in FIG. 1, in accordance with the present invention.

FIGS. 8A and 8B show flat 15 and arm 13 on both molding sides.

Figure 9A:
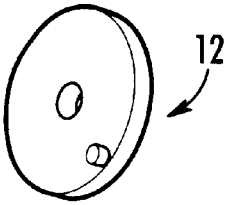
FIG. 9A is a rear view of a transition piece in accordance with the present invention.
Figure 9B:
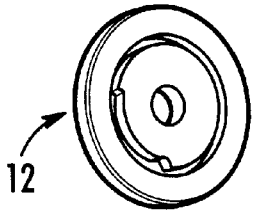
FIG. 9B is a front view of the transition piece in FIG. 9*a*, in accordance with the present invention.

FIGS. 9A and 9B illustrate a plastic fitting to attach the flag to the housing 3 with sufficient tension to hold a flag in an upright position.

In addition to improvements in shipping and storing of the individual components, the stackable component mailbox system according to the invention has other advantages. When displayed at a retail location, the components may be selected on the basis of color to create a personalized mailbox. Thermatic housings may be used to signify holidays such as Thanksgiving, Christmas, St. Patrick's Day and the Fourth of July. The housings are quickly and easily exchanged without tools.

Another advantage of the stackable component mailbox is easy repair. It is well know that a form of nighttime sport exists in many rural areas calls "mailbox bashing." When a conventional mailbox is destroyed in this manner, the entire mailbox must be replaced. The stackable component mailbox of this invention requires, at most, a new housing and door. The repair can be made quickly and without any tools.

In accordance with the present invention, therefore, a mailbox and a method of transporting and storing a plurality of mailboxes which maximizes the efficient use of cargo and storage space is provided. Also provided is a method and device for storing a plurality of mailboxes which allows quick and easy assembly, as well as the attachment of ornamental coverings on a mailbox housing. It will be evident to one skilled in the art that other objects are met by the foregoing invention.

It will be understood that various details of the invention may be changed without departing from the scope of the invention. Furthermore, the foregoing section description is for the purpose of illustration only, and not for the purpose of limitation since the invention is defined by the following claims.

We claim:

1. A mailbox assembly including mailbox components, said components comprising:

at least one substantially flat plastic base portion;

at least one door;

at least one elongated U-shaped housing sized to cover sides and top of said base portion;

means to close said housing at an end opposite said at least one door; and a flag, said components having reusable formed means for connection which allows the components to be assembled and disassembled repeatedly.

2. The mailbox assembly according to claim 1 wherein said U-shaped housing is adapted to fit concentric to and substantially flush within a second, identical U-shaped housing to enable stacking for maximum use of storage and cargo space.

3. The mailbox assembly according to claim 1 wherein said base portion is adapted to fit flat upon a second, identical base portion to enable stacking for maximum use of storage and cargo space.

4. The mailbox assembly according to claim 1 wherein said base portion defines at least one slot for receiving an ornamental cover for said U-shaped housing.

5. The mailbox assembly according to claim 1 wherein all components can be attached, detached and replaced without tools.

6. A method for storing and shipping a plurality of mailbox components comprising:

stacking a plurality of plastic base portions in a first stack;

stacking a plurality of plastic backing plates in a second stack;

stacking a plurality of metal elongated housings in a fourth stack;

stacking a plurality of plastic flags in a fifth stack.

* * * * *